United States Patent [19]

Muise

[11] 4,382,537

[45] May 10, 1983

[54] OCTAGONAL BULK BIN

[75] Inventor: Herbert D. Muise, Orange, Calif.

[73] Assignee: Weyerhaeuser Company, Tacoma, Wash.

[21] Appl. No.: 287,459

[22] Filed: Jul. 27, 1981

[51] Int. Cl.[3] ..... B65D 5/10

[52] U.S. Cl. ..... 229/39 R; 229/41 C

[58] Field of Search ..... 229/38, 39 R, 41 C

[56] References Cited

U.S. PATENT DOCUMENTS

| | | | |
|---|---|---|---|
| 183,950 | 10/1876 | Lockwood | 229/38 |
| 3,935,992 | 2/1976 | Uriu | 229/39 R |
| 4,114,795 | 9/1978 | Mulroy | 229/39 R |
| 4,119,266 | 10/1978 | Dempster | 229/39 R |
| 4,291,827 | 9/1981 | Mulroy | 229/39 R |

*Primary Examiner*—Herbert F. Ross

[57] ABSTRACT

An octagonal container closure in which the bottom closure flaps are held in place. Locking slots are placed in opposed side closure flaps. The slots are shaped and located to allow the corner closure flaps to extend through the slots and to lock behind the side closure flaps.

2 Claims, 6 Drawing Figures

Fig. 3
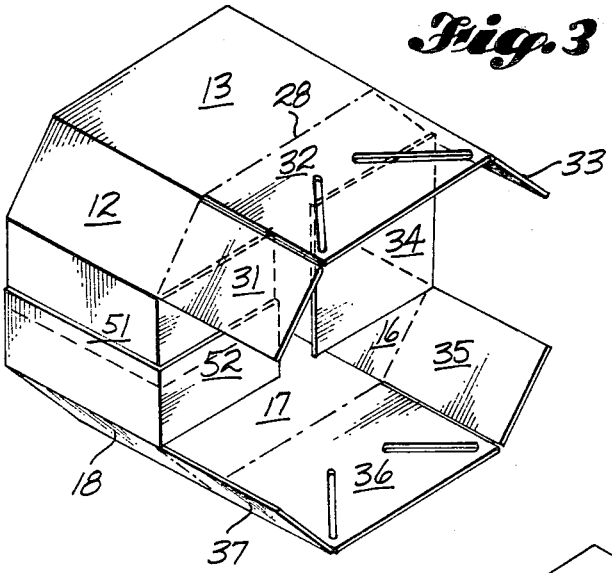
Fig. 4
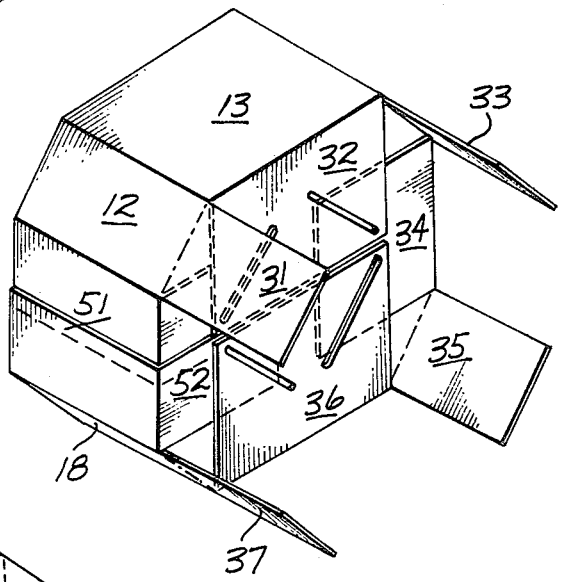
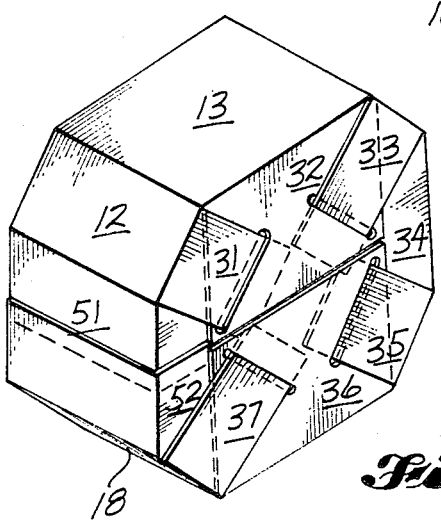
Fig. 5

OCTAGONAL BULK BIN

BACKGROUND OF THE INVENTION

1. Field of the Invention

A tubular container with a closure means.

2. Other Patents in the Field

Dempster U.S. Pat. No. 4,119,266 granted Oct. 10, 1978 disclosed an octagonal tubular container with a closing means. In this container, the side closure flaps have aligned slots through which the end closure flaps extend. The corner closure flaps are within the container.

SUMMARY OF THE INVENTION

A typical octagonal bulk bin is 47 inches long, 39 inches wide and 40 inches deep. It is used for packing fresh meat and will hold between 1500 and 2300 pounds of meat. Although the container is normally carried on a pallet, it is still necessary to hold the bottom closure flaps in place during transportation and storage.

The purpose of the present octagonal container closure is to hold the bottom closure flaps in place while maintaining the structural integrity of the flaps by using locking slots in opposed side closure flaps which remove as little material as possible from the side closure flaps. The apertures are shaped and located to allow the corner closure flaps to extend through the apertures and to lock behind the side closure flaps. The shape of the apertures provides a lock on the sides of the corner closure flap. The end closure flaps extend into the container above the side and corner closure flaps.

BRIEF DESCRIPTION OF THE DRAWINGS

FIGS. 3–5 are isometric views showing the container closure being formed.

DESCRIPTION OF THE PREFERRED EMBODIMENT

Figure 1:
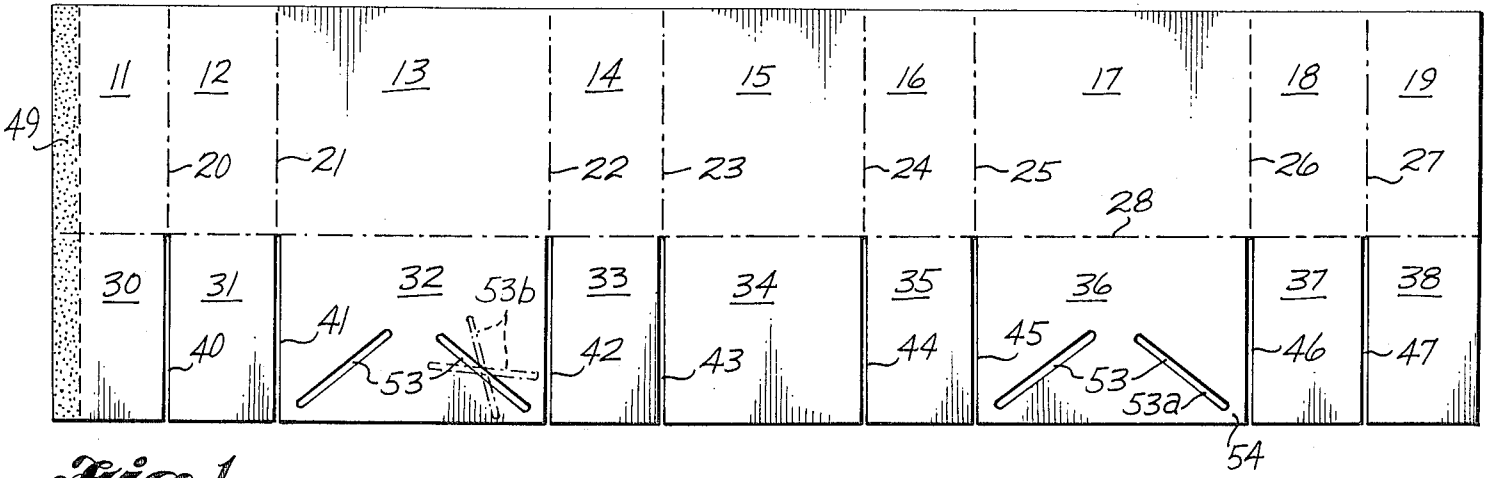
FIG. 1 is a top plan view of the blank for the container.

Blank 10 is divided into a first partial end panel 11, a first corner panel 12, a first side panel 13, a second corner panel 14, a second end panel 15, a third corner panel 16, a second side panel 17, a fourth corner panel 18 and a second partial end panel 19 by transverse scorelines 20,21,22,23,24, 25,26 and 27. The corner panels are narrower than the side and end panels. A series of closure flaps are connected to these panels along longitudinal scoreline 28 which forms the lower edge of the panels and the hinge between the panels and closure flaps. The first partial end closure flap 30 is attached to the first partial end panel 11; the first corner closure flap 31 is attached to the first corner panel 12; the first side closure flap 22 is attached to the first side flap 13; the second corner closure flap 33 is attached to the second corner panel 14; the second end closure flap 34 is attached to the second end panel 15; the third corner closure flap 35 is attached to the third corner panel 16; the second side closure flap 36 is attached to the second side panel 17; the fourth corner closure flap 37 is attached to the fourth corner panel 18; and the second partial end closure flap 38 is attached to the second partial end panel 19. The panels and flaps are substantially rectangular.

The closure flaps are separated by slots which are aligned with the transverse scorelines. The slots 40, 41, 42, 43, 44, 45, 46 and 47 are aligned respectively, with socrelines 20,21,22,23,24,25,26, and 27.

Figure 2:
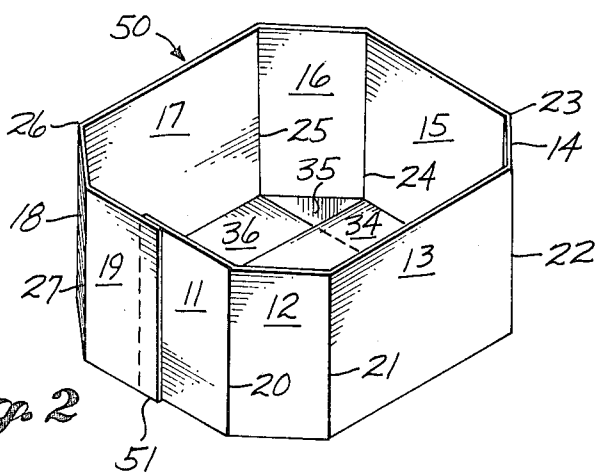
FIG. 2 is an isometric view of the formed container.

In the completed tubular container 50, shown in FIG. 2, the first partial end panel 11 and the second partial end panel 19 are adhered along manufacturers' joint 49 to form the first end panel 51 and the first partial end closure flap 30 and the second partial end closure flap 38 are adhered along manufacturers' joint 49 to form the first end closure flap 52.

The side closure flaps 32 and 36 each have a pair of slots 53. The slots 53 are oriented diagonally in the flaps extending diagonally from the direction of the outer corner of the flap adjacent the slot. For example, slot **53*a* extends diagonally from the direction of the adjacent outer corner 54 of side closure flap 36. The preferred orientation of slots 53 is shown in solid line. Other possible orientations are shown in dotted line at 53*b***. This range of orientations is covered by the term diagonal orientation from the direction of the outer corner of the side closure flap adjacent the slot.

Figure 6:
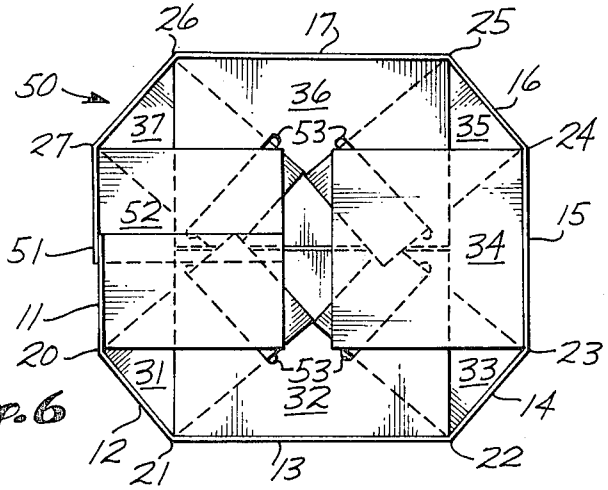
FIG. 6 is a top plan view of the container closure.

The location and alignment of the slots 53 in the side closure flap will allow the corner closure flaps to extend through the slots in the closed container and fit behind the side closure flap as shown in FIG. 6. The slot 53 may be entirely within the flap as shown or it may extend to the outer end or side edge of the flap. The intersection of its diagonal extension with the edge of the flaps need not be with the corner but may be with the side or outer end edge. Its exact location and direction will depend on the exact width and the width relationships of the side, corner and end panels.

In forming the container, the end closure flaps 52 and 34 are bent inwardly around score line 28 until they are aligned with the scoreline. The side closure flaps 32 and 36 are then bent inwardly around scoreline 28 until they are aligned with the scoreline. The corner closure flaps 31, 33, 35, and 37 are bent inwardly around scoreline and inserted through the slots 53. As can be seen in FIG. 6, the shape of the slots locks the corner closure flaps in position.

I claim:

1. An octagonal bulk bin comprising a pair of opposed side panels;

a pair of opposed end panels;

pairs of opposed corner panels extending between said side and end panels, said corner panels being narrower than said side and end panels;

said side, end and corner panels having a bottom edge in a common plane and top edge in a common plane;

said side, end and corner panels being substantially rectangular;

said side, end and corner panels defining a space having sides defined by said side, end and corner panels, a top defined by said top edge and a bottom defined by said bottom edge;

said bottom being closed by a bottom closure;

said bottom closure comprising end closure flaps having an edge hinge to said bottom edge of said end panels and a free inner edge opposite its hinged edge;

the maximum distance between said hinged edge and said free inner edge of each end closure flap being one-half the distance between said end panels;

each of said end closure flaps being substantially rectangular;

said end closure flaps extending across said bottom and being substantially aligned with said bottom edge;

side closure flaps having an edge hinged to said bottom edge of said side panels and a free inner edge opposite its hinged edge;

the maximum distance between said hinged edge and said free inner edge of each side closure flap being one-half the distance between said side panel;

each of said side closure flaps being substantially rectangular;

each of said side closure flaps having a pair of obliquely oriented slots;

each of said slots extending between two points located within said side closure flap; the first of said points being adjacent a free corner of said side closure flap defined by said free inner edge of said side closure flap and a side edge of said side closure flap, and near an edge defining said free corner; the second of said points being nearer said hinged edge of said side closure flap than said first point and being nearer the center line of said side closure flap transverse to said hinged edge than said first point;

the placement of said slots in one side closure flap being identical to the placement of said slots in the other side closure flap; each slot in a side closure flap being a mirror image of the other slot in the same side closure flap;

said side closure flaps extending across said bottom along the outer faces of said end closure flaps;

corner closure flaps having an edge hinged to said bottom edges of said corner panels and a free inner edge opposite its hinged edge;

the maximum distance between said hinged edge and said free inner edge of each of said corner closure flaps being one-half the distance between said corner panels;

each of said corner closure flaps being substantially rectangular;

each of said corner closure flaps extending across said bottom along the outer faces of said side and end closure flaps, through said oblique slots and having its free inner edge between said side and end closure flaps;

each of said slots being transverse to its respective corner closure flap.

2. A planar rectangular blank for a bulk container comprising in sequence, a first partial end panel, a first corner panel, a first side panel, a second corner panel, a second end panel, a third corner panel, a second side panel, a fourth corner panel and a second partial end panel;

said panels being hingedly connected by scorelines;

said corner panels being narrower than said side and second end panels;

said side, end and corner panels having a common bottom edge and common top edge;

said side, end and corner panels being substantially rectangular;

closure flaps extending from the lower edges of said panels and being hingedly connected to said panels by a scoreline;

said closure flaps being separated from each other;

said closure flaps comprising a first partial end closure flap connected to said first partial end panel, a first corner closure flap connected to said first corner panel, a first side closure flap connected to said first side panel, a second corner closure flap connected to said second corner panel, a second end closure flap connected to said second end panel, a third corner closure flap connected to said third corner panel, a second side closure flap connected to said second side panel, a fourth corner closure flap connected to said fourth corner panel and a second partial end closure flap connected to said second partial end panel;

each of said closure flaps having an edge hinged to said bottom edge of its said respective panel and a free edge opposite its hinged edge;

the distance between said hinged edge and said free edge of each of said closure flaps being equal;

the maximum distance between said hinged edge and said free edge of each of said closure flaps being one-half the distance between the side panels upon erection of said container;

each of said closure flaps being substantially rectangular;

each of said side closure flaps having a pair of obliquely oriented slots whereby the slots extend from the free corners of each side closure flap to the generally central portion of said side corner flaps but unconnected;

each of said slots extending between two points located within said side closure flap; the first of said points being adjacent a free corner of said side closure flap defined by said free edge of said side closure flap and a side edge of said side closure flap the second of said points being nearer said hinged edge of said side closure flap than said first point and being nearer the center line of said side closure flap transverse to said hinged edge;

the placement of said slots in one side closure flap being identical to the placement of said slots in the other side closure flap; each slot in a side closure flap being a mirror image of the other slot in the same side closure flap;

whereby the corner closure flaps will extend through and behind said slots and be transverse to said slots in the closed container.

* * * * *

UNITED STATES PATENT AND TRADEMARK OFFICE

CERTIFICATE OF CORRECTION

PATENT NO. : 4,382,537

DATED : May 10, 1983

INVENTOR(S) : Herbert D. Muise

It is certified that error appears in the above—identified patent and that said Letters Patent is hereby corrected as shown below:

In Claim I, Column 2, line 61,"hinge" should be --hinged in claim I, column 3, line 9, "panel" should be --panels in claim 2, column 4, line 42, "corner" should be --closure Signed and Sealed this

*Nineteenth* Day of *June 1984*

[SEAL]

*Attest:*

GERALD J. MOSSINGHOFF

*Attesting Officer*

*Commissioner of Patents and Trademarks*